US009657619B2

(12) United States Patent
Hillen

(10) Patent No.: US 9,657,619 B2
(45) Date of Patent: May 23, 2017

(54) METHOD OF EXHAUST GAS AFTERTREATMENT

(71) Applicant: GE Jenbacher GmbH & Co OG, Jenbach (AT)

(72) Inventor: Friedhelm Hillen, Jenbach (AT)

(73) Assignee: GE JENBACHER GMBH & CO OG, Jenbach (AT)

( * ) Notice: Subject to any disclaimer, the term of this patent is extended or adjusted under 35 U.S.C. 154(b) by 0 days.

(21) Appl. No.: 14/714,623

(22) Filed: May 18, 2015

(65) Prior Publication Data

US 2015/0337706 A1 Nov. 26, 2015

(30) Foreign Application Priority Data

May 20, 2014 (AT) ..... A 377/2014

(51) Int. Cl.

| | |
|---|---|
| ***F01N 3/00*** | (2006.01) |
| ***F01N 3/10*** | (2006.01) |
| ***F01N 3/20*** | (2006.01) |
| ***F01N 3/26*** | (2006.01) |
| *F01N 13/00* | (2010.01) |

(52) U.S. Cl.

CPC ..... *F01N 3/106* (2013.01); *F01N 3/10* (2013.01); *F01N 3/103* (2013.01); *F01N 3/20* (2013.01); *F01N 3/26* (2013.01); *F01N 13/0097* (2014.06); *F01N 2240/02* (2013.01); *F01N 2240/10* (2013.01); *F01N 2240/12* (2013.01)

(58) Field of Classification Search

USPC ..... 60/286, 287, 288, 295, 297, 303, 324

See application file for complete search history.

(56) References Cited

U.S. PATENT DOCUMENTS

| | | | | |
|---|---|---|---|---|
| 3,172,251 | A * | 3/1965 | Johnson | F01N 3/20 181/228 |
| 3,211,534 | A | 10/1965 | Ridgway | |
| 3,276,202 | A | 10/1966 | Gary | |
| 3,826,089 | A | 7/1974 | Nakajima et al. | |
| 3,854,288 | A | 12/1974 | Heitland et al. | |
| 4,233,812 | A | 11/1980 | Leistritz | |
| 5,437,152 | A | 8/1995 | Pfefferle | |
| 6,261,093 | B1 | 7/2001 | Matros et al. | |
| 6,530,215 | B2 * | 3/2003 | Alkemade | F01N 3/025 60/274 |

(Continued)

FOREIGN PATENT DOCUMENTS

| | | |
|---|---|---|
| DE | 1 476 528 | 3/1970 |
| DE | 30 45 666 | 7/1982 |
| EP | 0 668 471 | 8/1995 |

OTHER PUBLICATIONS

European Search Report issued Oct. 1, 2015 in corresponding European Application No. 15167318 (with English translation).

(Continued)

*Primary Examiner* — Binh Q Tran

(74) *Attorney, Agent, or Firm* — Wenderoth, Lind & Ponack, L.L.P.

(57) ABSTRACT

A method of exhaust gas aftertreatment of an exhaust gas of an internal combustion engine includes pre-treating the exhaust gas pre-treated by using a thermoreactor to catalytically oxidize the exhaust gas. Preferably, the exhaust gas is catalytically oxidized in the thermoreactor.

3 Claims, 3 Drawing Sheets

(56) References Cited

U.S. PATENT DOCUMENTS

| | | | | |
|---|---|---|---|---|
| 6,955,042 | B1 * | 10/2005 | Wnuck | F01N 3/035 60/286 |
| 7,334,400 | B2 * | 2/2008 | Yan | F01N 13/011 423/239.1 |
| 7,386,977 | B2 * | 6/2008 | Ancimer | B01D 53/8612 48/197 R |
| 7,571,602 | B2 * | 8/2009 | Koch | F01N 3/0807 48/197 R |
| 8,268,273 | B2 * | 9/2012 | Doring | F01N 3/025 422/105 |
| 8,534,051 | B2 * | 9/2013 | Tsujimoto | F01N 3/0871 60/274 |
| 9,016,051 | B2 * | 4/2015 | Iwasaki | F01N 3/025 60/300 |
| 9,115,625 | B2 * | 8/2015 | Igarashi | F01N 3/025 |

OTHER PUBLICATIONS

Technical Description of CL.AIR® arrangement mentioned on p. 1 of the specification http://site.ge-energy.com/prod_serv/products/recip_engines/du/emission_red_sys/clair.htm.

* cited by examiner

STATE OF THE ART

METHOD OF EXHAUST GAS AFTERTREATMENT

BACKGROUND OF THE INVENTION

The present invention concerns a method of exhaust gas aftertreatment. Methods of exhaust gas aftertreatment are frequently used to comply with the emission limit values of internal combustion engines. A method which is also known from the field of exhaust gas aftertreatment of caloric power plants is regenerative thermal oxidation (RTO) in which unburnt hydrocarbons and other oxidizable exhaust gas constituents are thermally oxidized. In regenerative thermal oxidation the exhaust gas is firstly passed by way of a heat storage means generally comprising ceramic bulk material or honeycomb bodies in order finally to pass into the reaction chamber. In the reaction chamber, the exhaust gas is further heated by additional heating devices until thermal oxidation of the unwanted exhaust gas constituents can take place. The exhaust gas then flows through a further heat storage means to the exhaust pipe and is discharged into the environment.

In operation, the flow direction is alternately altered whereby the exhaust gas is pre-heated before reaching the reaction chamber, thereby achieving an energy savings in further heating of the exhaust gas. The additional heating effect can be implemented by gas injection or burners (so-called support gas) or an electrical additional heating device. The reaction chamber generally has a free flow cross-section whereby the residence time of the exhaust gas in the reaction chamber is increased and oxidation can take place in the form of a gaseous phase reaction. Carbon monoxide (CO) and methane ($CH_4$) are particularly relevant among the species to be oxidized in the exhaust gas. Such an arrangement is known for example by the trade name CL.AIR® from GE Jenbacher. In that method, exhaust gas is heated to about 700-800° C. and oxidation of the unburnt hydrocarbons and the carbon monoxide is effected to give water vapor and carbon dioxide. The CL.AIR® thermoreactor is in the form of a regenerative heat exchanger and comprises two storage masses, a reaction chamber and a switching-over mechanism. The exhaust gas flows coming from the engine at a temperature of about 530° C. by way of a switching-over mechanism into a first storage mass where it is heated to approximately 800° C. In the reaction chamber, the exhaust gas reacts with the oxygen present, in which case carbon monoxide and unburnt hydrocarbons are oxidized to give carbon dioxide and water. When flowing through the second storage mass, the exhaust gas again gives off heat and is at a temperature of between 550 and 570° C. when reaching the switching-over mechanism which passes it to the chimney or a downstream-disposed waste heat recovery operation.

Regenerative thermal oxidation affords a robust method with which even large exhaust gas mass flows can be economically post-treated.

Thermoreactors as described hitherto are adapted to oxidize both methane and also carbon monoxide. That entails some disadvantages in operation.

In order to be able to break down carbon monoxide, a relatively high temperature and a relative long residence time are required in the thermoreactor.

SUMMARY OF THE INVENTION

Therefore, the object of the present invention is to provide a method and a suitable apparatus for exhaust gas aftertreatment, wherein the temperatures in the thermoreactor and the required residence time can be reduced. That object is attained by a method of exhaust gas aftertreatment and an exhaust gas aftertreatment apparatus having the features of the present invention.

It has surprisingly been found that it is more desirable for the oxidation of methane and the oxidation of carbon monoxide to be implemented separately. Because the exhaust gas pre-treated by the thermoreactor is catalytically oxidized, preferably being catalytically oxidized in the thermoreactor, the thermoreactor therefore has to be designed for lower temperatures and a shorter residence time for the exhaust gas, and nonetheless the carbon monoxide can be reduced to a satisfactory extent.

It is therefore provided according to the invention that firstly methane is reduced by thermal oxidation. The parameters in the thermoreactor are selected so that partial oxidation of methane is allowed, in which carbon monoxide is produced, instead of it being reduced—as is usually provided in thermoreactors. The resulting pre-treated exhaust gas therefore contains a larger amount of carbon monoxide than in the original exhaust gas flow while unburnt hydrocarbons, in particular methane, are already oxidized. Subsequently, the exhaust gas which has been pre-treated in that way is fed to a catalytic oxidation device. That can be, for example, in the form of an oxidation catalyst comprising a catalyst carrier medium as is known for example for exhaust gas aftertreatment in the automobile field.

Alternatively, the oxidation catalyst can be implemented by catalytic coating of volume portions of the thermal oxidation catalyst. That can be effected for example by volume portions of the ceramic storage mass present in the thermal oxidation catalyst being provided with a catalytically active surface or by other, catalytically operative materials being introduced.

An exhaust gas aftertreatment apparatus according to the invention therefore includes an intake for exhaust gas, a thermal reaction zone, and at least one catalytic reaction zone. The at least one catalytic reaction zone is disposed downstream of the thermal reaction zone in the flow direction of the exhaust gas through the exhaust gas aftertreatment apparatus.

That arrangement provides that the exhaust gas which is pre-treated in the thermoreactor and which is rich in carbon monoxide encounters the oxidation catalyst for breaking down carbon monoxide and there the carbon monoxide is broken down by catalytic oxidation.

Particularly preferably, the thermal reaction zone and the at least one catalytic reaction zone are arranged in a common housing. That can be implemented for example by a volume portion with catalytically active material being integrated into the reaction zone of the thermoreactor. Alternatively, the catalytically active region is provided in the ceramic storage mass of the thermoreactor. That describes the situation where a catalytically active region is formed by catalytic coating on a part of the surface of the ceramic loose material of the thermoreactor.

Alternatively or additionally, the catalytic reaction zone is connected downstream of the thermal reaction zone in a housing separate from the thermal reaction zone in the flow direction of the exhaust gas through the exhaust gas aftertreatment apparatus. That embodiment describes the situation where the thermoreactor and the oxidation catalyst are in the form of separate components. In that case, a thermoreactor corresponds in respect of its configuration to the state of the art and downstream of which is connected an oxidation catalyst.

BRIEF DESCRIPTION OF THE DRAWINGS

The invention is described in greater detail hereinafter with reference to the drawings, in which.

DETAILED DESCRIPTION OF THE DRAWINGS

Figure 1:
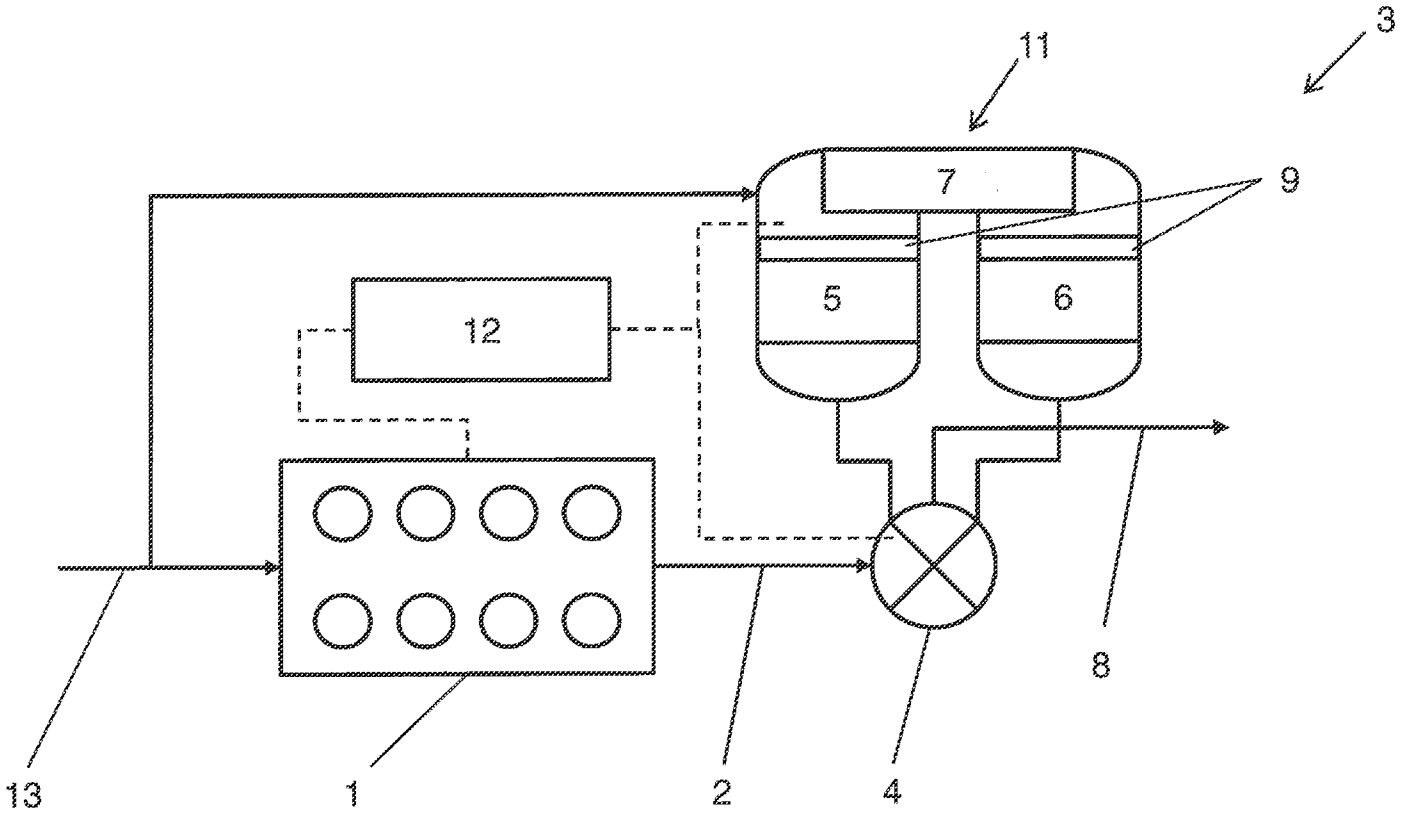
FIG. 1 is a diagrammatic view of an internal combustion engine having an exhaust gas aftertreatment apparatus.

The detailed specific description now follows. FIG. 1 shows a diagrammatic view illustrating an internal combustion engine 1 connected by way of the exhaust gas manifold 2 to the exhaust gas aftertreatment apparatus 3. The flow direction of the exhaust gas through the thermoreactor 11 can be altered by the switching-over mechanism 4. Thus, in operation, the direction of flow of the exhaust gas can alternatingly first be through the first storage mass 5, the thermal reaction zone 7, and the second storage mass 6. Upon a reversal in the flow direction, the exhaust gas firstly flows through the second storage mass 6, then through the thermal reaction zone 7, and finally through the first storage mass 5. After flowing through the exhaust gas aftertreatment apparatus 3, the exhaust gas leaves the arrangement by way of the conduit 8 and is fed to a chimney or a waste heat recovery arrangement (both of these are not shown). In the embodiment of FIG. 1, the volume portions 9 of the storage masses 5 and 6, that are towards the reaction chamber 7, are provided with a catalytic coating or a catalytically active material. In operation of the exhaust gas aftertreatment apparatus 3, therefore, the volume portions (catalytic reaction zones) 9 take over the task of catalytic oxidation of the exhaust gas which has been pre-treated in the thermal reaction zone 7 of the thermoreactor.

For the sake of completeness, the open loop/closed loop control device 12 is shown, which on the one hand can receive signals from the internal combustion engine 1 and the exhaust gas aftertreatment apparatus 3, and which on the other hand can also send commands to actuating members of the exhaust gas aftertreatment apparatus 3. Also shown is the fuel line 13, by way of which the internal combustion engine 1 is supplied with fuel, for example gas fuel. A branching can be provided on the fuel line 13, by way of which support gas can be fed to the thermoreactor 11 for additional heating.

Figure 2:
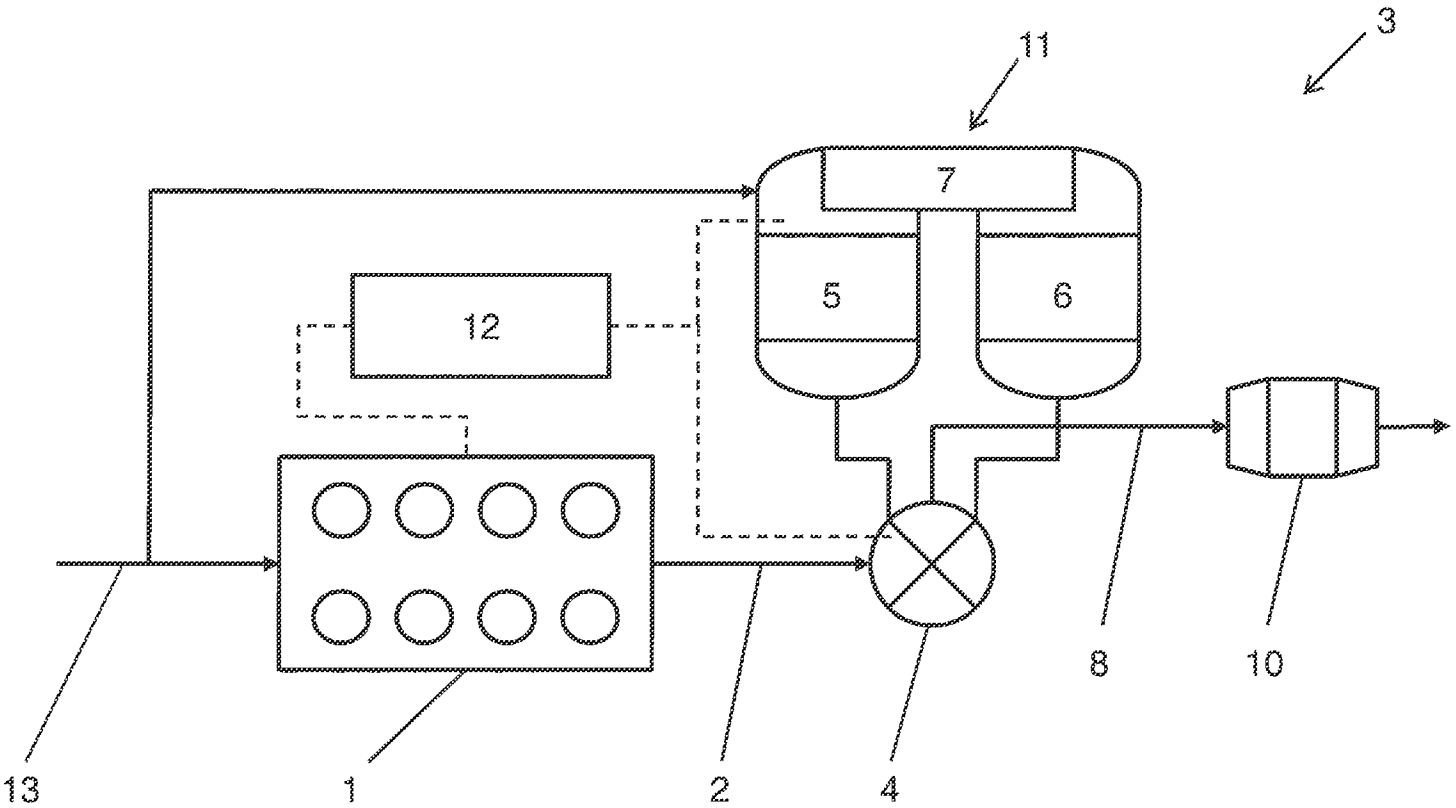
FIG. 2 is a diagrammatic view of an internal combustion engine having an exhaust gas aftertreatment apparatus in an alternative configuration.

FIG. 2 shows a diagrammatic view of an internal combustion engine 1 with an exhaust gas aftertreatment apparatus 3 similar to FIG. 1, but in this case the exhaust gas aftertreatment apparatus 3 is formed from a thermoreactor 11 comprising storage masses 5 and 6, a thermal reaction zone 7, and an oxidation catalyst 10 provided downstream of the thermoreactor in the conduit 8. The flow direction through the thermoreactor 11 can again be alternatingly changed by way of the switching-over mechanism 4. In this embodiment, the thermoreactor 11 does not have any catalytically coated volume portions. The exhaust gas pretreated in the thermoreactor 11 flows through the oxidation catalyst 10 and from there is passed to a chimney or an exhaust gas heat utilization arrangement (both not shown).

Figure 3:
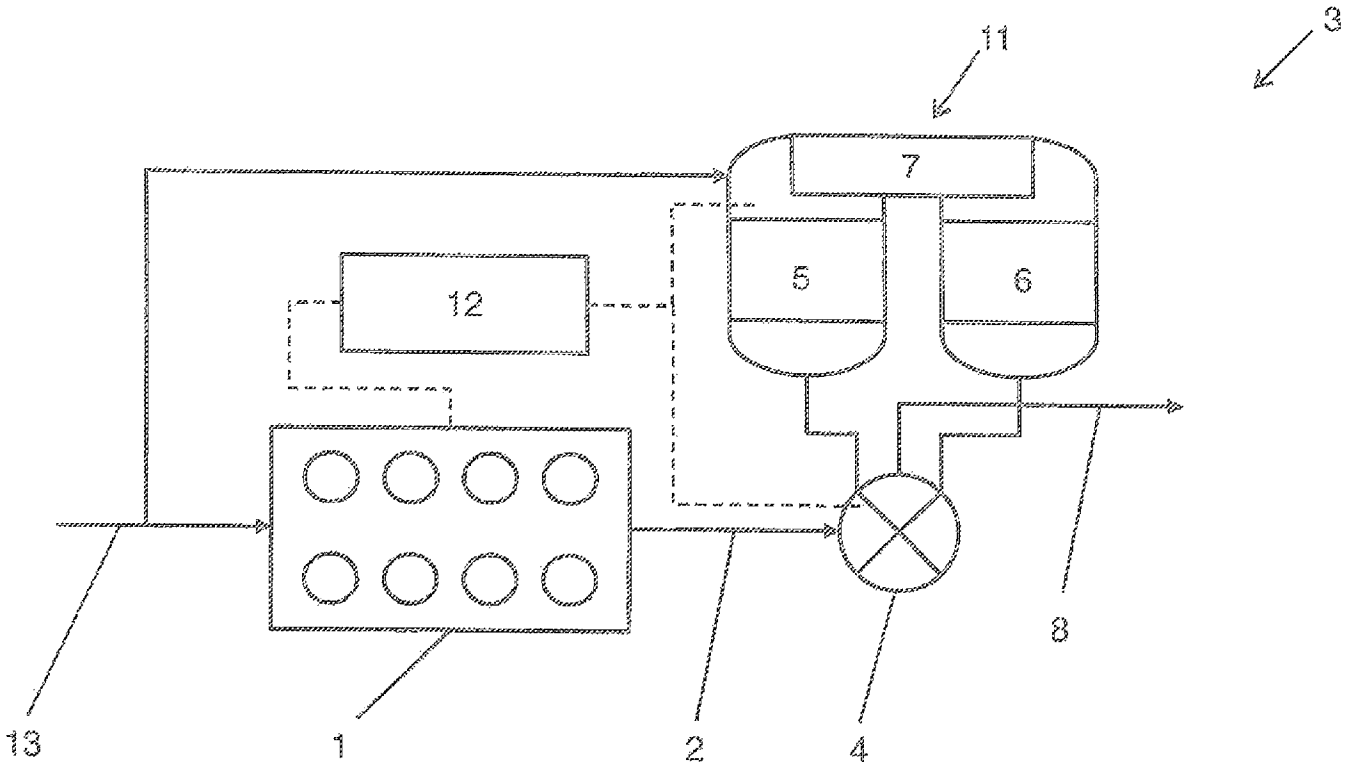
FIG. 3 is a diagrammatic view of an internal combustion engine with exhaust gas aftertreatment according to the state of the art.

FIG. 3 is a diagrammatic view showing an internal combustion engine 1 with an exhaust gas aftertreatment apparatus according to the state of the art. Here there is a thermoreactor without catalytically coated zones.

LIST OF REFERENCES USED

1 internal combustion engine
2 exhaust gas manifold
3 exhaust gas aftertreatment apparatus
4 switching-over mechanism
5, 6 thermal storage masses
7 thermal reaction zone
8 exhaust gas conduit
9 catalytically coated/catalytically active zone or zones
10 oxidation catalyst
11 thermoreactor
12 open loop/closed loop control device
13 fuel line guide system

The invention claimed is:

1. An exhaust gas aftertreatment apparatus for an internal combustion engine, said exhaust gas aftertreatment apparatus comprising:

an intake for exhaust gas;

a thermoreactor including a thermal reaction zone, a first storage mass, and a second storage mass, said thermoreactor being configured to perform a partial oxidation of methane to form carbon monoxide;

a catalytic reaction zone connected downstream of said thermoreactor in a flow direction of the exhaust gas through said exhaust gas aftertreatment apparatus, said catalytic reaction zone being configured to break down by catalytic oxidation the carbon monoxide formed by said thermoreactor; and a switching-over mechanism configured to switch a direction of flow of the exhaust gas through said exhaust gas aftertreatment apparatus between a first direction through the first storage mass, the thermal reaction zone, and then the second storage mass, and a second direction through the second storage mass, the thermal reaction zone, and then the first storage mass.

2. The exhaust gas aftertreatment apparatus as set forth in claim 1, wherein said thermal reaction zone of said thermoreactor and said catalytic reaction zone are arranged in a common housing.

3. The exhaust gas aftertreatment apparatus as set forth in claim 1, wherein said catalytic reaction zone is connected downstream of said thermal reaction zone in a housing separate from said thermal reaction zone in the flow direction of the exhaust gas through said exhaust gas aftertreatment apparatus.

* * * * *